US005927583A

United States Patent [19]

Kyle

[11] Patent Number: 5,927,583

[45] Date of Patent: Jul. 27, 1999

[54] TICKET PROCESSING MACHINE HAVING A STATIONARY DETACHMENT IMPLEMENT

[75] Inventor: Lawrence A. Kyle, Jarrell, Tex.

[73] Assignee: Texas Instruments Incorporated, Dallas, Tex.

[21] Appl. No.: 08/789,823

[22] Filed: Jan. 28, 1997

Related U.S. Application Data

[63] Continuation of application No. 08/611,610, Mar. 8, 1996, abandoned, which is a continuation of application No. 08/298,493, Aug. 30, 1994, abandoned.

[51] Int. Cl.[6] ..... B26F 3/02; B65H 35/10

[52] U.S. Cl. ..... 225/100; 101/66; 400/621

[58] Field of Search ..... 225/100, 101; 101/66, DIG. 44; 400/621, 691, 693

[56] References Cited

U.S. PATENT DOCUMENTS

| | | | |
|---|---|---|---|
| 3,425,607 | 2/1969 | Sargent | 225/100 |
| 4,397,410 | 8/1983 | Schueler | 225/100 |
| 4,618,085 | 10/1986 | Kimura et al. | 225/100 |
| 4,688,708 | 8/1987 | Irvine et al. | 225/100 |
| 4,695,171 | 9/1987 | Sapitowicz | 101/66 |
| 4,697,726 | 10/1987 | Gaucher | 225/100 |
| 4,827,841 | 5/1989 | White, Sr. | 101/66 |
| 5,133,615 | 7/1992 | Saito et al. | 400/621 |
| 5,232,293 | 8/1993 | Hibon et al. | 400/621 |

FOREIGN PATENT DOCUMENTS

| | | | |
|---|---|---|---|
| 0136275 | 8/1984 | Japan | 400/621 |
| 0146377 | 6/1991 | Japan | 400/621 |

OTHER PUBLICATIONS

IBM Technical Disclosure Bulletin, vol. 30, No. 5, Oct. 1987, "Self–Service Terminal Issue of Ticket Media".

*Primary Examiner*—Rinaldi I. Rada
*Assistant Examiner*—Charles Goodman
*Attorney, Agent, or Firm*—Ronald O. Neerings; Richard L. Donaldson

[57] ABSTRACT

A device that mechanically separates continuous edge tied automated ticket and boarding pass (ATB) coupons (22) by pulling the coupon to coupon perforations past a stationary tapered edge (50). The existing coupon transport drive provides the energy for coupon separation. Compared to existing methods, this design is low cost, quiet, and forgiving of coupon perforation registration.

22 Claims, 11 Drawing Sheets

TICKET PROCESSING MACHINE HAVING A STATIONARY DETACHMENT IMPLEMENT

This application is a continuation of Ser. No. 08/611,610, filed on Mar. 8, 1996, which is a continuation of application Ser. No. 08/298,493, filed Aug. 30, 1994 both abandoned.

FIELD OF THE INVENTION

The present invention relates to the field of ticket and boarding pass coupon processing. More specifically, the present invention relates to the separation of automated ticket and boarding pass (ATB) coupons,

BACKGROUND OF THE INVENTION

Automated ticket and boarding pass (ATB) coupons are processed and issued in accordance with international air transport association (IATA) regulations. Typically, pre-processed ATB coupons are packaged and loaded into processing equipment in one of two forms: individually cut, or continuous end to end, each coupon sharing a perforated edge with the adjoining coupon.

When processing continuous ATB type coupons, one of the initial steps is to separate the leading coupon from the others in the input stack. Typically, this is done with some or all of the following steps:

1) The leading coupon is driven by a motorized means and is positioned so that the coupon to coupon perforation is at the appropriate location for detachment.
2) At this point, the coupon is stopped and sometimes held taut.
3) A motorized blade, bar, or shear, usually tapered as to break one perforation tie at a time, then engages the stationary perforation thereby causing separation.
4) The drive mechanism then carries the detached coupon to the next station in the process.

Unfortunately, ticket processing devices using stationary coupons and a moving implement have several inherent disadvantages. One disadvantage is the expense and noise level of motor and/or solenoid driven implements. Another disadvantage includes the substantial costs associated with motors, motor driver electronics, implement linkages, and noise control materials. Yet another disadvantage is that such devices typically require a reasonably accurate perforation registration for successful detachment.

SUMMARY OF THE INVENTION

The present invention disclosed herein comprises a motorless automated ticket and boarding pass (ATB) coupon separation device that mechanically separates continuous edge tied automated ticket and boarding pass (ATB) coupons by pulling the coupon to coupon perforations past a stationary edge. The stationary edge is tapered so as to break one perforation tie at a time as the coupon to coupon perforations are pulled past the stationary edge. The existing coupon transport drive provides the energy for coupon separation. Compared to existing methods, this design is low cost, quiet, and forgiving of coupon perforation registration.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION OF PREFERRED EMBODIMENTS

Figure 1:
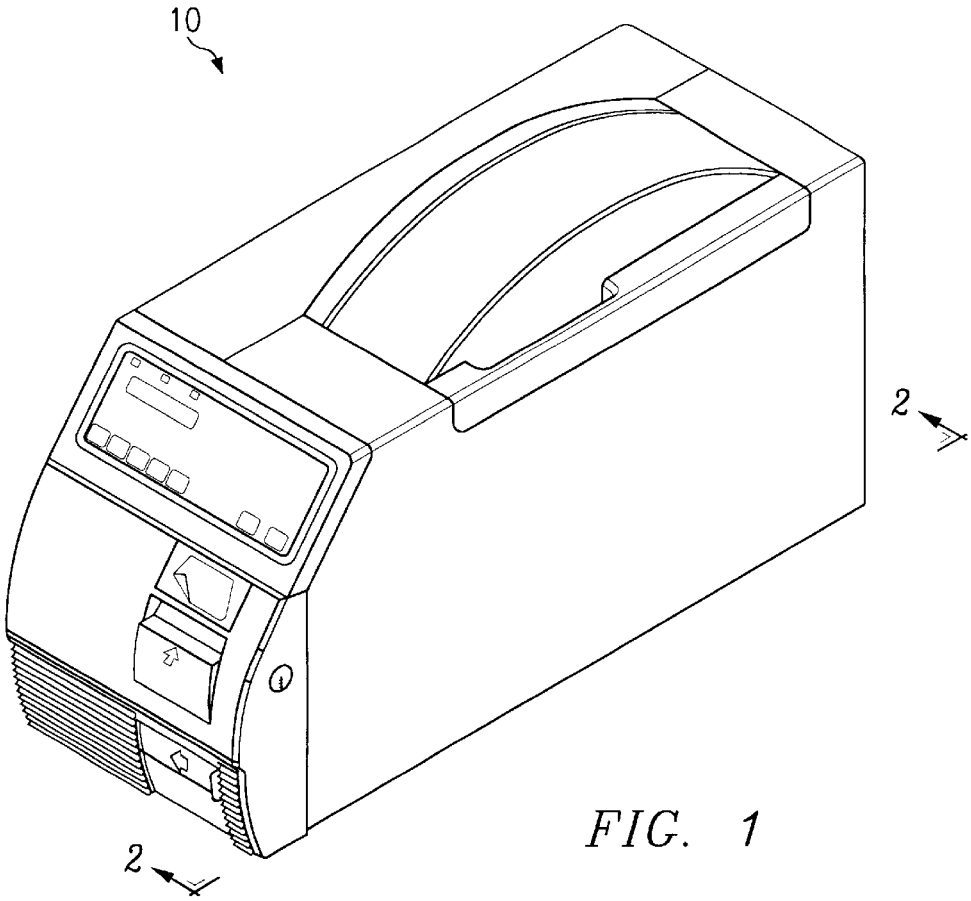
FIG. 1 illustrates a perspective view of an Automated Ticket and Boarding Pass (ATB) processing machine.
Figure 12:
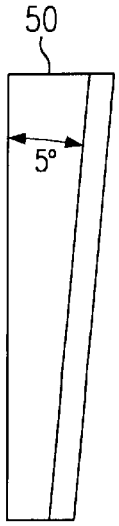
Figure 13:
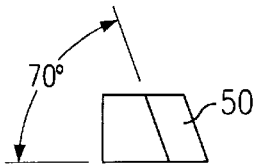
Figure 14:
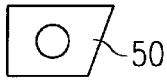

FIG. 1 illustrates an Automated Ticket and Boarding Pass (ATB) processing machine (Texas Instruments Incorporated Model 1400 Printer), generally at 10. ATB processing machine 10 processes and issues tickets and/or coupons, hereinafter "coupon(s)", in accordance with international air transport association (IATA) regulations. The ATB processing machine illustrated in FIG. 1 processes individually cut ATB coupons inserted into the machine one at a time or coupons packaged and loaded in a continuous end to end format, each coupon sharing a perforated edge with an adjoining coupon.

Figure 2:
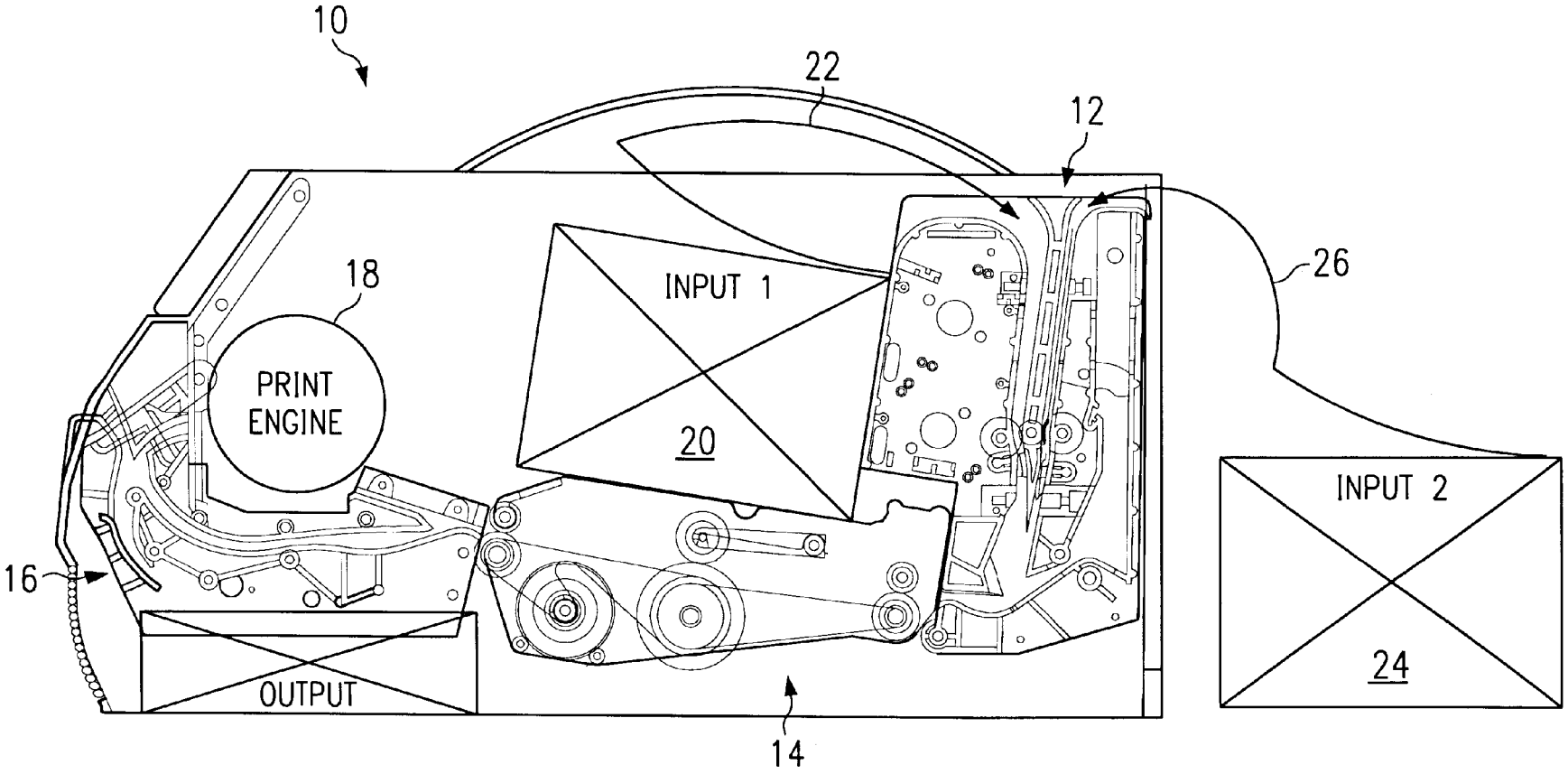
FIG. 2 illustrates a side sectional view of the Automated Ticket and Boarding Pass (ATB) processing machine of FIG. 1 along section lines 1—1.

FIG. 2 illustrates a side sectional view of the Automated Ticket and Boarding Pass (ATB) processing machine 10 of FIG. 1 along section lines 1—1. The machine comprises a paperfeed module 12, a magnetics module 14, a manual insertjoutput module 16, a print engine 18 and an input module 20 for holding pre-processed coupons 22 loaded in a continuous end to end format. A second input module 24 can be placed adjacent the backside of machine 10 for holding a second supply of pre-processed coupons 26 loaded in a continuous end to end format.

Figure 3:
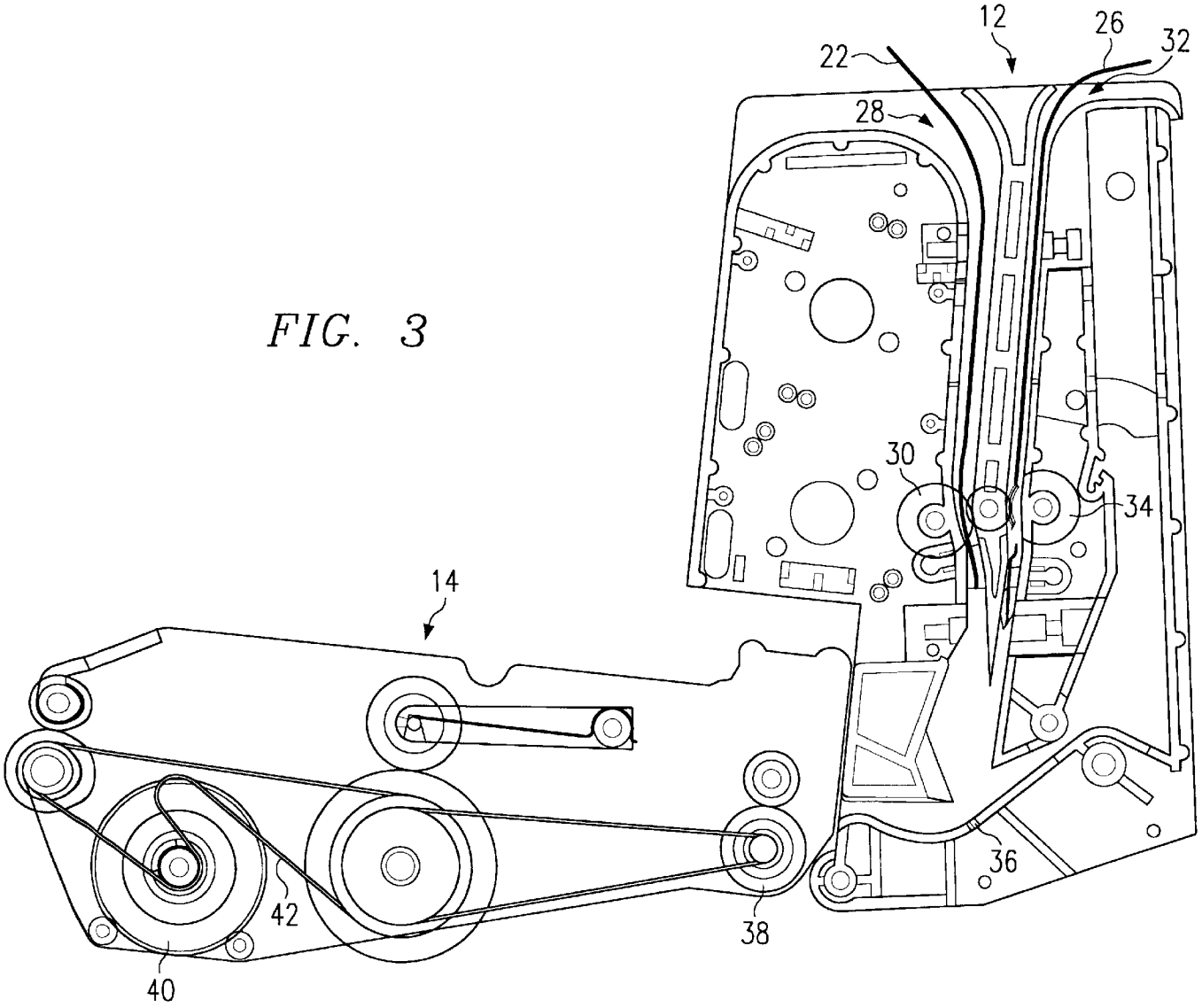
FIG. 3 illustrates an enlarged view of the magnetics and paperfeed modules of the Automated Ticket and Boarding Pass (ATB) processing machine of FIG. 2. First and second coupon chains are shown inserted in the paperfeed module to first and second drive tire sets.

FIG. 3 illustrates an enlarged view of the paperfeed and magnetics modules of FIG. 2. The magnetics module is an encoder that forms and/or reads a magnetic record on the magnetic strip on the coupons. Many of the components of the magnetics module of FIG. 2 are well known in the art and are omitted in FIG. 3 better to show the coupon drive mechanism and feedpath. A first chain of continuous coupons 22 in end to end format is loaded from first input module 20 into opening 28. First coupon chain 22 is inserted until the leading edge of the coupon chain is engageable by a first drive tire set 30. Additionally, or alternatively, a chain of continuous coupons 26 in end to end format may be loaded from second input module 24 into opening 32. Coupon chain 26 is inserted until the leading edge of the coupon chain 26 is engageable by a second drive tire set 34 (one tire of said second drive tire set being common to said first drive tire set—if two coupon chains are used only one tire drive set will be engaged at any one time). When a coupon is to be processed, one of the first and second drive tire sets is activated to engage and advance its respective coupon chain.

Figure 4:
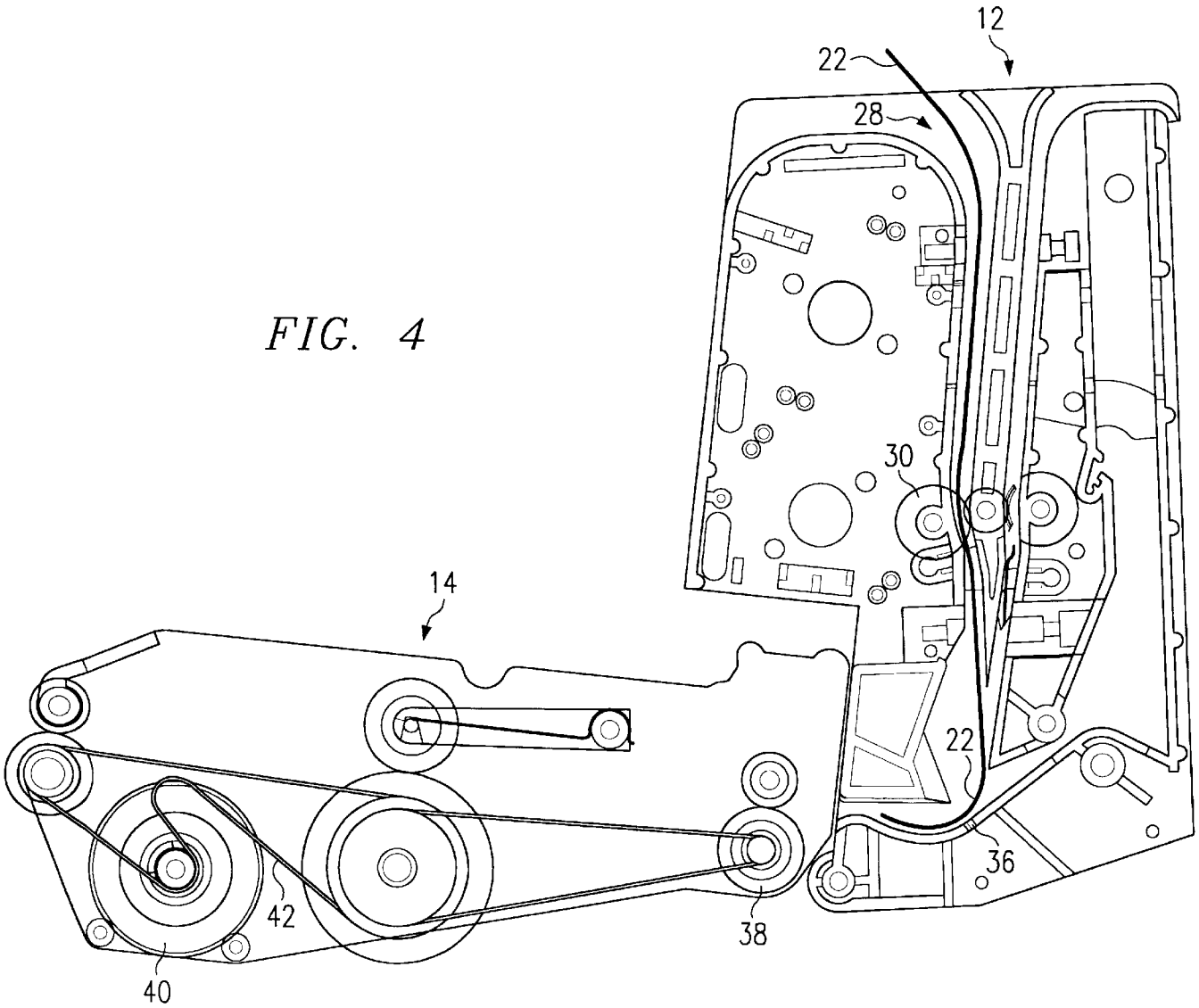
FIG. 4 illustrates the magnetics and paperfeed modules of FIG. 3. The first coupon chain has been advanced in the paperfeed module and the leading edge of the first coupon chain is shown bending around the curved surface near the bottom of the paperfeed module.
Figure 5:
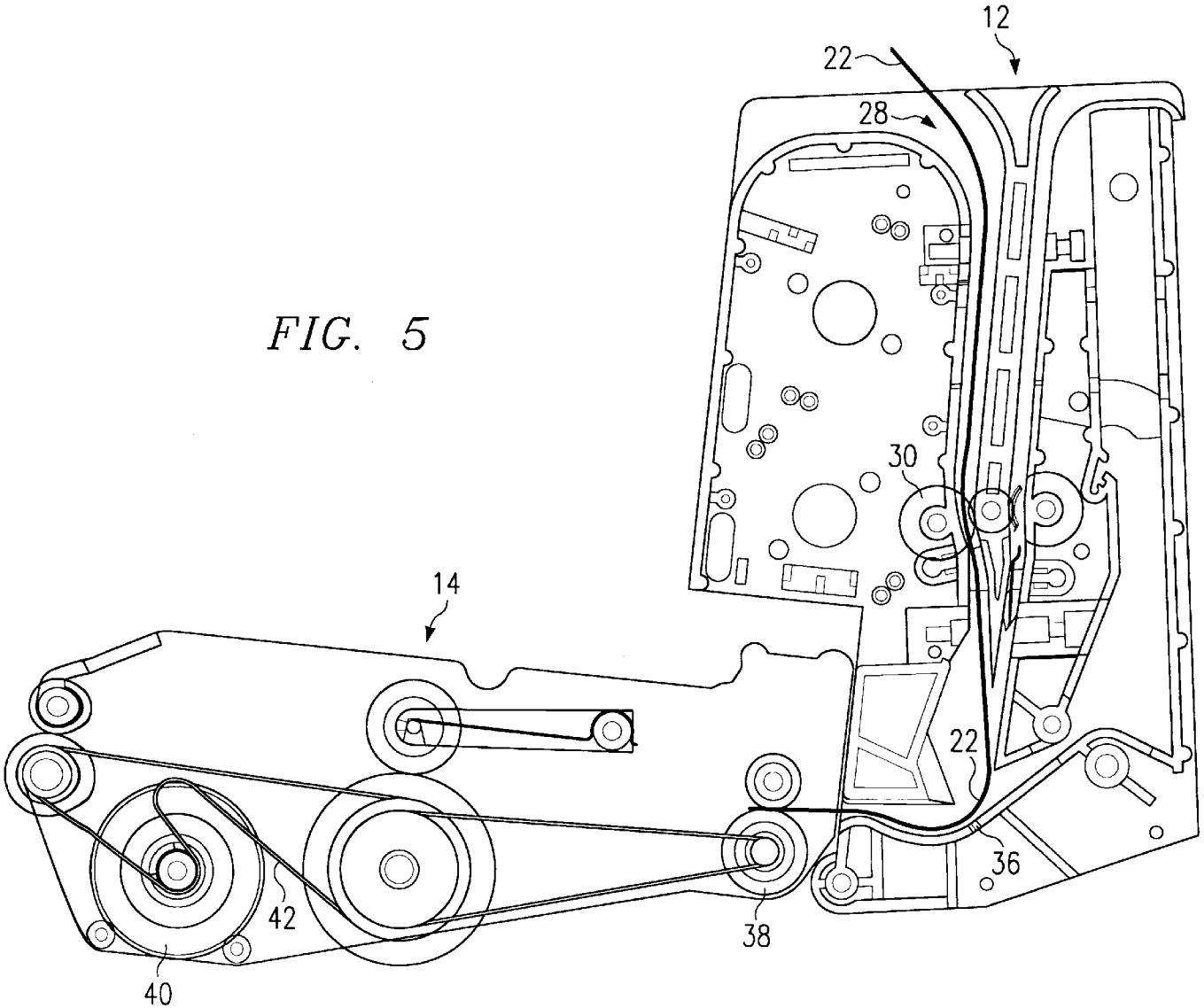
FIG. 5 illustrates the magnetics and paperfeed modules of FIG. 4. The leading edge of the first coupon chain is shown engaged to a third drive tire set (first drive tire set in the magnetics module) in the magnetics module.

The selected drive tire set (in this case the first drive tire set) advances the selected coupon chain (coupon chain 22 in this case) down a path defined by guides for guiding the coupon chain and toward a curved portion 36 of one of said guides. 36 near the bottom of paperfeed module 12 (coupon chain 26 omitted for clarity of explanation), as shown in FIG. 4. Coupon chain 22 follows the contour of curved surface 36 and eventually engages a third drive tire set 38 which is located in magnetics module 14, as shown in FIG. 5. The motor 40 and drive tire set drive train 42 of the third drive tire set are separate from the motor or motors and drive tire set drive trains of the first and second drive tire sets.

Figure 6:
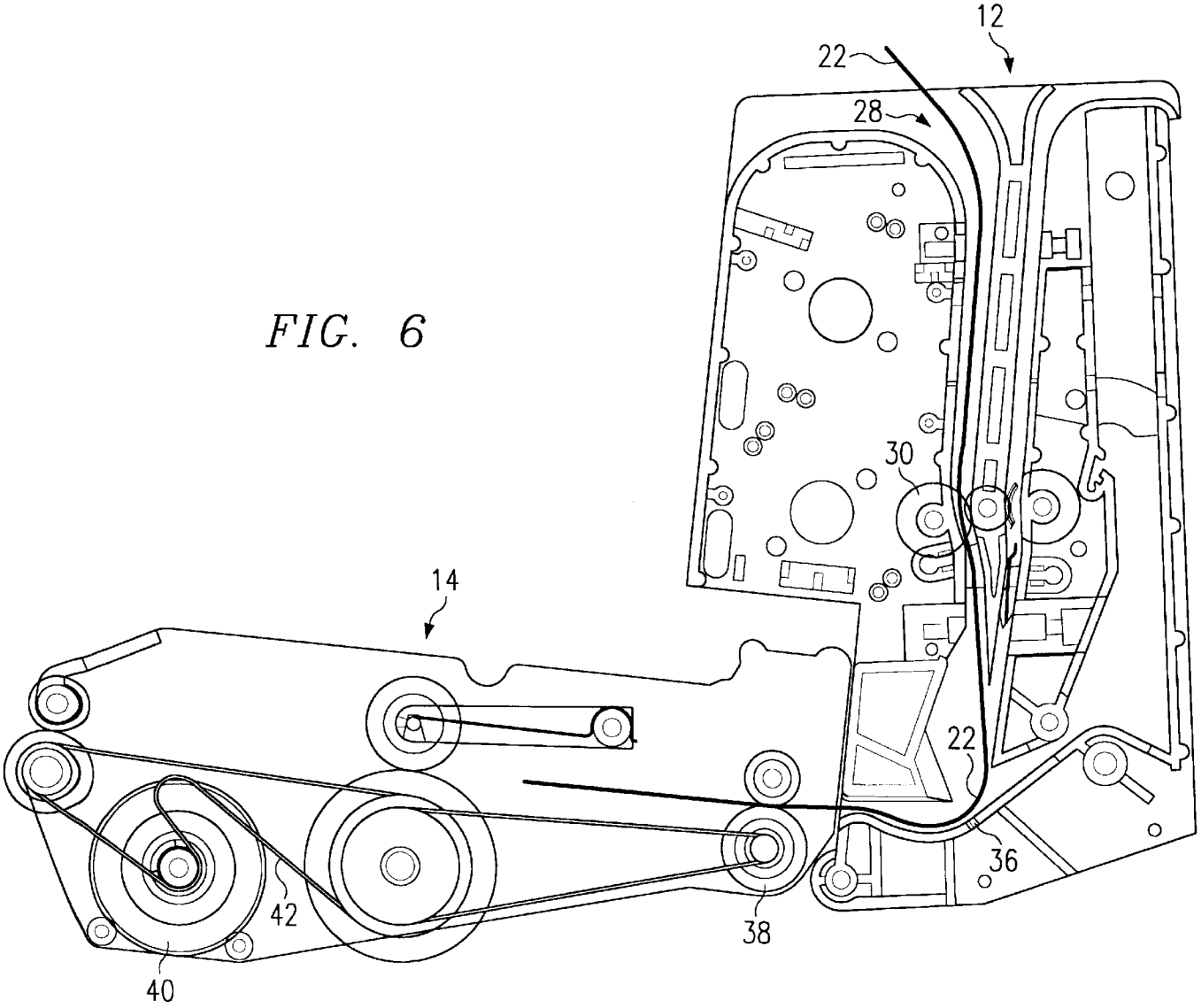
FIG. 6 illustrates the magnetics and paperfeed modules of FIG. 5. The leading edge of the first coupon chain is shown being advanced toward a fourth drive tire set (second drive tire set in the magnetics module) in the magnetics module.
Figure 7:
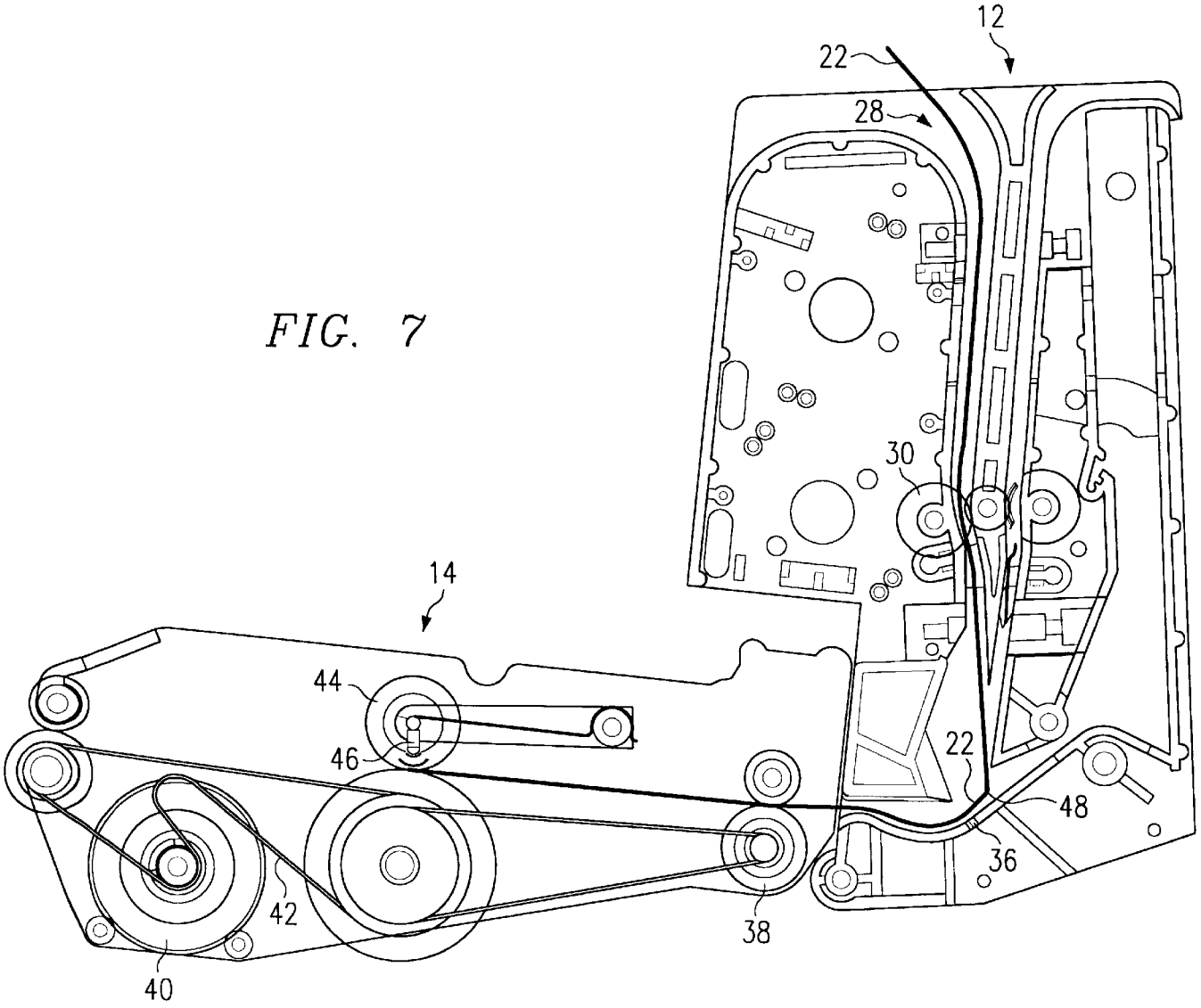
FIG. 7 illustrates the magnetics and paperfeed modules of FIG. 6. The leading edge of the first coupon chain is shown engaged to a fourth drive tire set (second drive tire set in the magnetics module) in the magnetics module.
Figure 8:
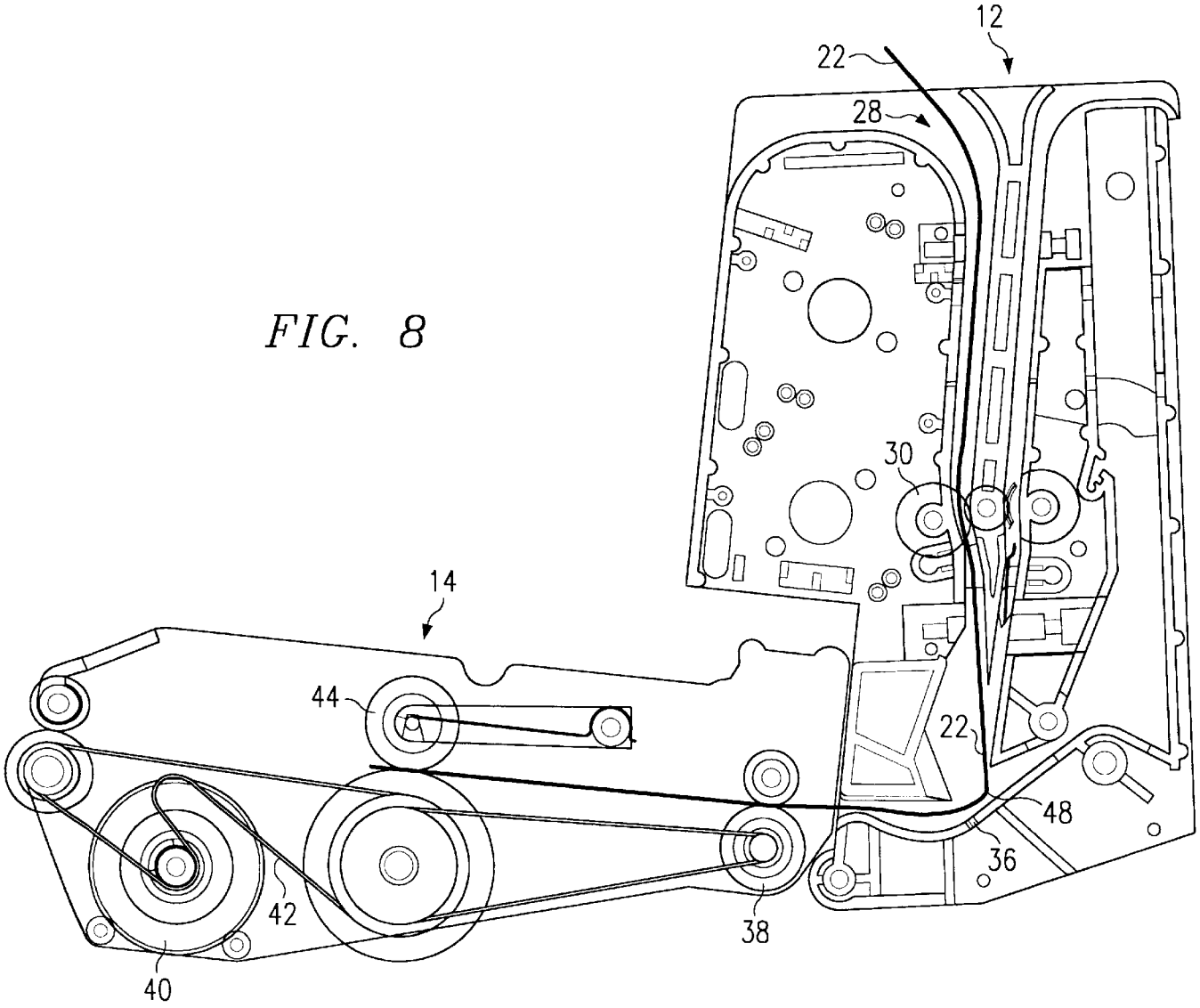
FIG. 8 illustrates the magnetics and paperfeed modules of FIG. 7. Slack in the first coupon chain is being taken up around the curved surface near the bottom of the paperfeed module as the first drive tire set is stopped and the third and fourth drive tire sets continue to operate.
Figure 9:
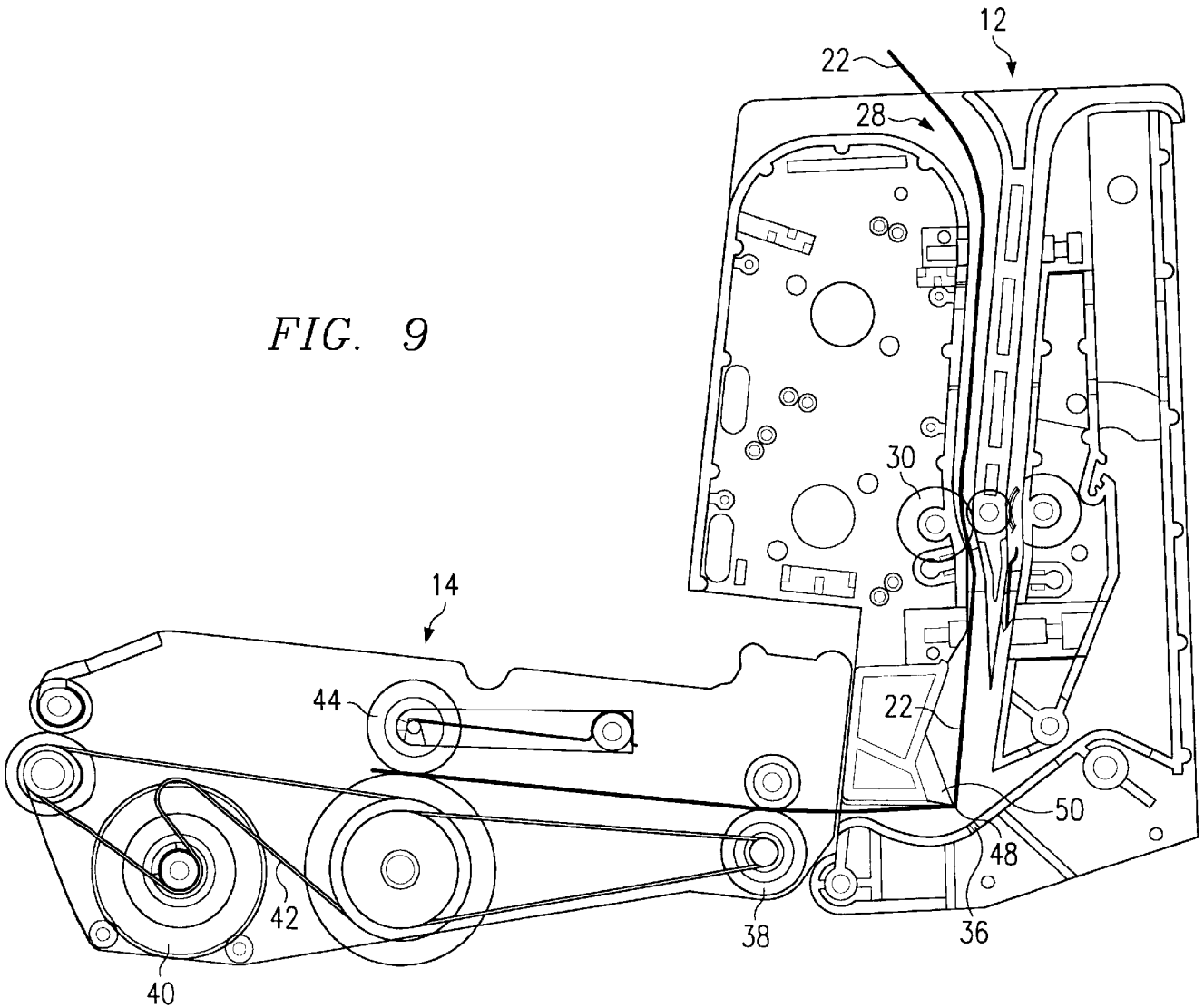
FIG. 9 illustrates the magnetics and paperfeed modules of FIG. 8. Slack in the first coupon chain is completely taken up around the curved surface near the bottom of the paperfeed module as the first drive tire set is stopped and the third and fourth drive tire sets continue to operate. The perforation between adjacent coupons in the coupon chain is drawn into a detachment implement.

The third drive tire set advances the selected coupon chain at the same rate and speed as the first or second drive tire set. The third drive tire set continues to advance coupon chain 22, shown in FIG. 6, until a fourth drive tire set 44 engages coupon chain 22, as shown in FIG. 7. A photo sensor 46 is mounted adjacent the fourth drive tire set and is tripped when the leading edge of the coupon chain interrupts the sensor beam. When the photo sensor is tripped, power to the motor driving the first or second drive tire set is disconnected, stopping the advancement of the selected coupon chain at the first or second drive tire set. While the first or second drive tire set is stopped, the third and fourth drive tire sets continue to advance the selected coupon at the selected speed, pulling out in the selected coupon chain, as shown in FIGS. 8, and pulling the perforation 48 between adjacent coupons in the coupon chain into a detachment implement 50, as shown in FIG. 9.

Figure 10:
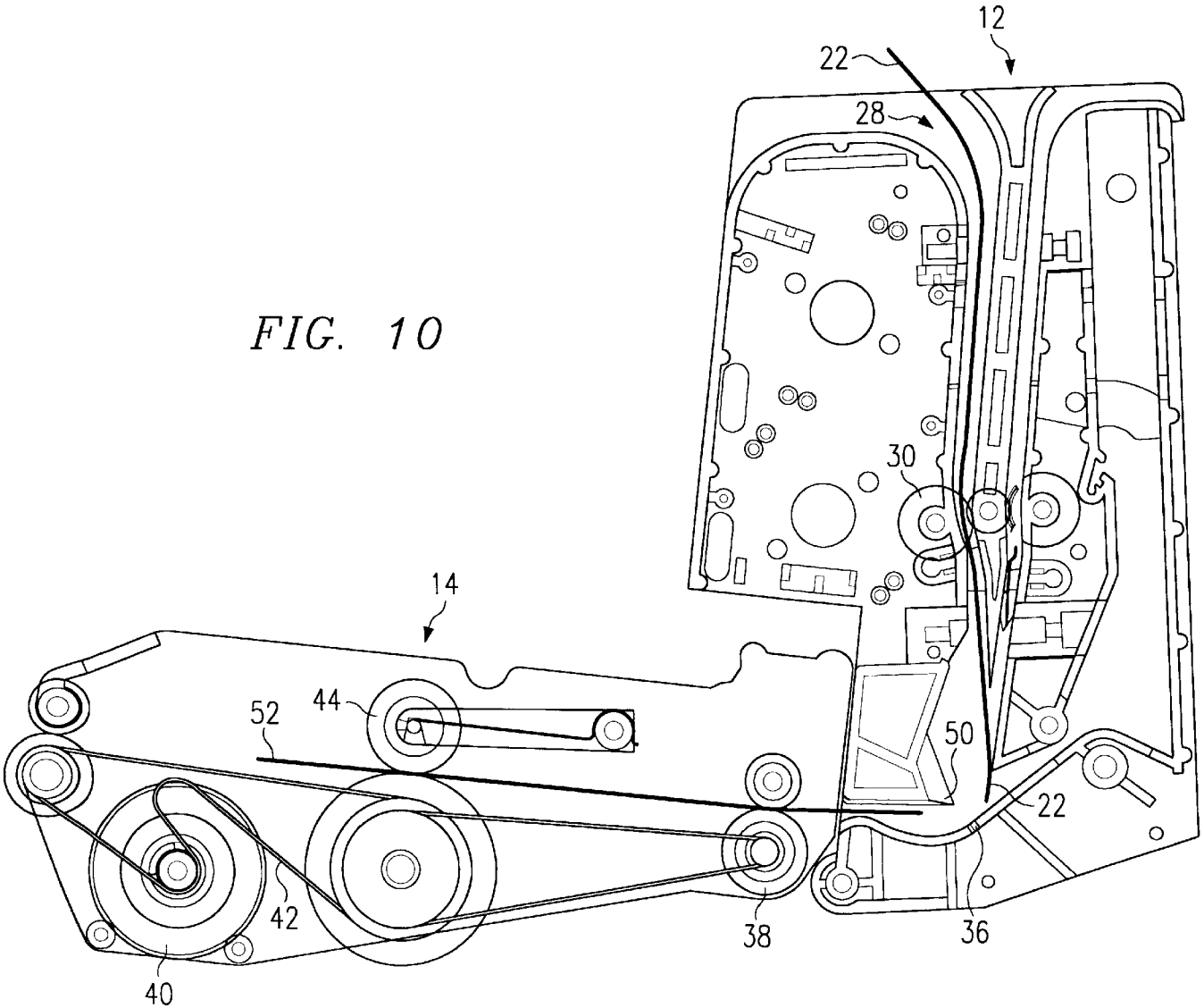
FIG. 10 illustrates the magnetics and paperfeed modules of FIG. 9. The third and fourth drive tire sets draw the leading coupon past the detachment implement, separating the leading coupon from the coupon chain.
Figure 11:
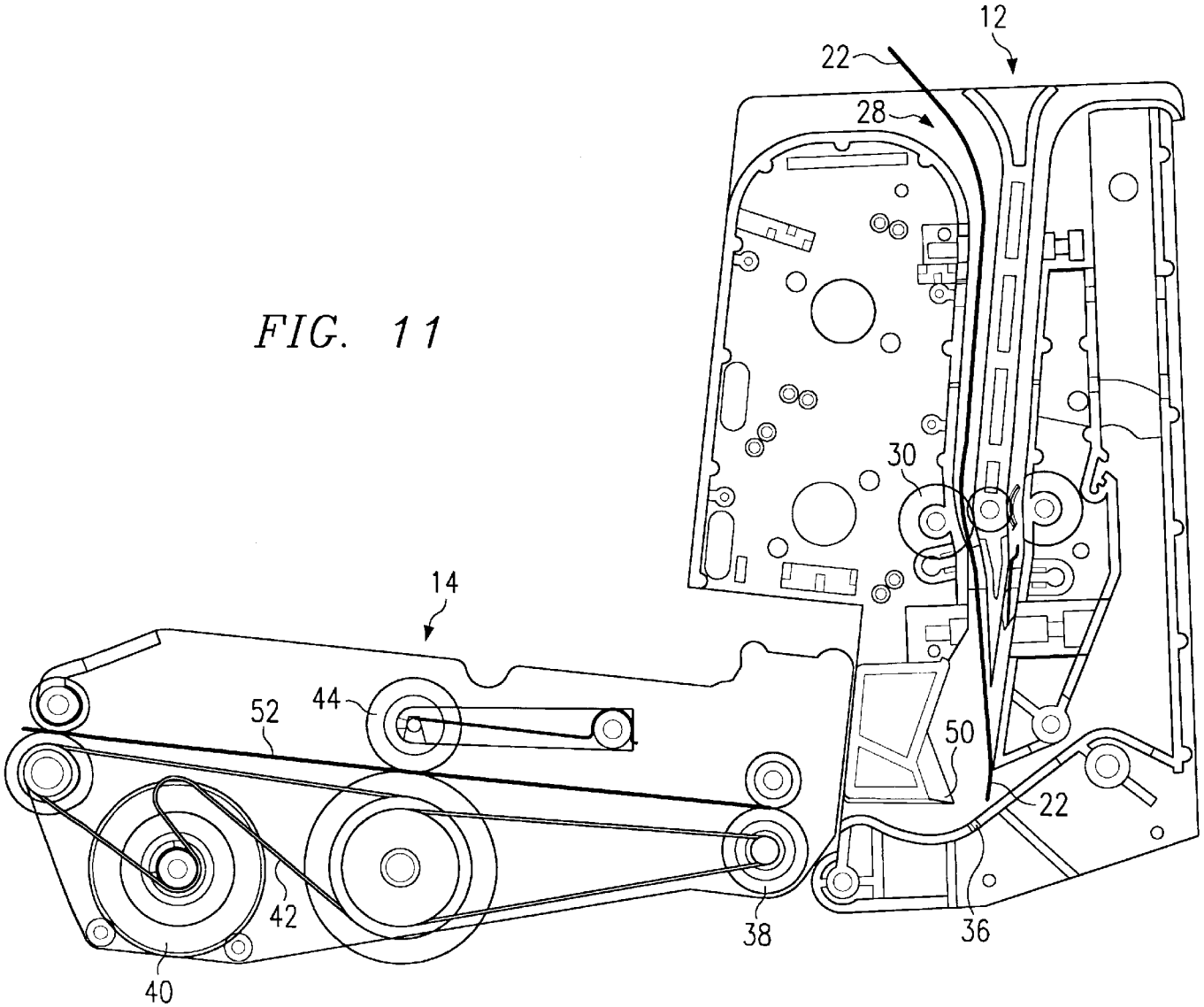
FIG. 11 illustrates the magnetics and paperfeed modules of FIG. 10. The third and fourth drive tire sets advance the detached coupon to a fifth drive tire set (third drive tire set in the magnetics module) in the magnetics module.

The detachment implement is typically a blade, bar, or shear, usually tapered as to break one perforation tie at a time. The coupon being driven by the third and fourth drive tire sets is separated from the next coupon in the chain as the coupon driven by the third and fourth drive tire sets is drawn past detachment implement 50, as shown in FIG. 10. The detached coupon 52 is advanced to the print engine 18 for printing and thereafter to manual insert/output module 16, as shown in FIG. 1 1. For multiple coupon processing, firmware connected to magnetics module 14 determines how long the motor driving the first drive tire set must remain off to accomplish successful coupon separation. In this embodiment of the invention, the firmware counts the number of motor steps of motor 40 times the distance said third and fourth drive tire sets move a coupon per motor step. The time the firmware keeps the motor driving the first drive tire set off should be sufficient to allow coupon chain 22 to be drawn taut against and pulled past detachment implement 50. The firmware turns the motor driving the first drive tire set back on to advance coupon chain 22 as separated coupon 52 is advanced to print engine 18 for printing and thereafter to manual insert/output module 16 for further processing. If only one coupon is to be processed, the motor driving the first drive tire set remains off until another coupon is to be processed.

In the embodiment of the invention illustrated in FIGS. 2–11, detachment implement 50 is a molded portion of paper feed modules 12 (plastic in this particular case—other sturdy materials maybe used in conjunction with or in lieu of plastic). In the embodiment of the invention illustrated in FIGS. 2–11, detachment implement 50 is tapered horizontally (at least 5 degrees) and vertically.

The invention disclosed herein overcomes each of the previously discussed shortcomings of the prior art. The unique aspect of this invention is that, in contrast to previous methods, the coupon perforation is pulled past a stationary detachment implement thereby causing separation. Advantages of the present invention include:

1) No additional motors, solenoids or associated electronics are required for coupon separation.
2) No complicated implement linkage is required.
3) Very low sound level associated with the coupon separation function.
4) Cost for the stationary separation function is many times less that the cost of the prior art separation functions.
5) The perforation registration requirement is less critical than other designs.
6) The leading coupon does not have to slow down or stop for the separation function.

While this invention has been described with reference to an illustrative embodiment, this description is not to be construed in a limiting sense. For example, while the invention has been described as being advantageous in the separation of coupons packaged and loaded in a continuous end to end format, each coupon sharing a perforated edge with the adjoining coupon, the invention could be used in any sheet separation process which has a sufficiently curved material path and sufficient separation pull force for the material in question.

What is claimed:

1. A ticket/coupon issuing apparatus, comprising:

a path defined by guides for guiding tickets or coupons formatted in an end to end chain, each ticket or coupon sharing a perforated edge with an adjoining ticket or coupon;

a stationary detachment implement opposite a curved portion of one of said guides;

a first transport mechanism for moving said tickets or coupons toward, into and past said curved portion of one of said guides; and a second transport mechanism for moving said tickets or coupons away from said curved portion of one of said guides, individual speeds at which said first and second transport mechanisms move said tickets or coupons being alterable to allow the perforated edges of adjoining tickets or coupons to be drawn into and past said stationary detachment implement to separate said tickets or coupons.

2. The ticket/coupon issuing apparatus of claim 1, in which said stationary detachment implement has an edge tapered so as to break said perforated edges one tie at a time.

3. The ticket/coupon issuing apparatus of claim 1, in which said first transport mechanism comprises at least one tire drive set for moving said tickets or coupons toward said curved portion of said ticket or coupon path.

4. The ticket/coupon issuing apparatus of claim 1, in which said second transport mechanism comprises at least one tire drive set for moving said tickets or coupons away from said curved portion of said ticket or coupon path.

5. The ticket/coupon issuing apparatus of claim 1, further including a sensor for detecting a leading edge of a ticket or coupon and a motor controller for changing the speed of the first transport mechanism.

6. The ticket/coupon issuing apparatus of claim 5, in which said motor controller starts and stops the first transport mechanism.

7. The ticket/coupon issuing apparatus of claim 6, in which said motor controller stops said first transport mechanism for a predetermined amount of time.

8. The ticket/coupon issuing apparatus of claim 5, in which said sensor is a photo sensor.

9. The ticket/coupon issuing apparatus of claim 1, in which second transport mechanism further transports said separated coupons to a location within said apparatus for further coupon processing.

10. The ticket/coupon issuing apparatus of claim 1, in which said second transport mechanism is part of a module that forms and/or reads a magnetic record on a magnetic strip on the tickets or coupons.

11. The ticket/coupon issuing apparatus of claim 10, in which said second transport mechanism further transports said separated coupons to a location where said coupons are printed.

12. The ticket/coupon issuing apparatus of claim 1, wherein said stationary detachment implement and said first transport mechanism are housed in a common module.

13. The ticket/coupon issuing apparatus of claim 1, in which the perforated edges of adjoining coupons are drawn into and past an edge of said stationary detachment implement.

14. The ticket/coupon issuing apparatus of claim 1 in which said stationary detachment implement has a single edge.

15. The ticket/coupon issuing apparatus of claim 1 in which said stationary detachment implement includes a tapered blade having a single edge.

16. A ticket/coupon issuing apparatus, comprising:

a path defined by guides for guiding tickets or coupons formatted in an end to end chain, each ticket or coupon sharing a perforated edge with an adjoining ticket or coupon;

a stationary detachment implement opposite a curved portion of one of said guides;

a first motor for driving a first transport mechanism, said first transport mechanism being operable to move said tickets or coupons toward, into and past said curved portion of one of said guides; and a second motor for driving a second transport mechanism, said second transport mechanism being operable to move said tickets or coupons away from said curved portion of one of said guides, individual speeds at which said first and second transport mechanisms move said tickets or coupons being alterable to allow the perforated edges of adjoining tickets or coupons to be drawn into and past said stationary detachment implement to separate said tickets or coupons.

17. The ticket/coupon issuing apparatus of claim 16, in which the perforated edges of adjoining coupons are drawn into and past an edge of said stationary detachment implement.

18. The ticket/coupon issuing apparatus of claim 17, in which said edge extends along a single plane.

19. The ticket/coupon issuing apparatus of claim 18, in which said edge is tapered so as to break said perforated edges one tie at a time.

20. The ticket/coupon issuing apparatus of claim 18, in which said first transport mechanism comprises at least one tire drive set for moving said tickets or coupons toward said curved portion of said ticket or coupon path.

21. The ticket/coupon issuing apparatus of claim 18, in which said second transport mechanism comprises at least one tire drive set for moving said tickets or coupons away from said curved portion of said ticket or coupon path.

22. The ticket/coupon issuing apparatus of claim 18, further including a sensor for detecting a leading edge of a ticket or coupon and a motor controller for changing the speed of the first transport mechanism.

* * * * *